US010458440B2

(12) United States Patent
Sarafin et al.

(10) Patent No.: US 10,458,440 B2
(45) Date of Patent: Oct. 29, 2019

(54) FLAPPER AND ARMATURE/FLAPPER ASSEMBLY FOR USE IN A SERVOVALVE

(71) Applicant: Hamilton Sundstrand Corporation, Charlotte, NC (US)

(72) Inventors: Jakub Sarafin, Wroclaw (PL); Michal Zgórecki, Grodkow (PL)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 0 days.

(21) Appl. No.: 15/399,846

(22) Filed: Jan. 6, 2017

(65) Prior Publication Data

US 2017/0261116 A1 Sep. 14, 2017

(30) Foreign Application Priority Data

Mar. 10, 2016 (EP) ..... 16159650

(51) Int. Cl.
*F15B 13/043* (2006.01)

(52) U.S. Cl.
CPC ..... *F15B 13/0438* (2013.01)

(58) Field of Classification Search
CPC ..... F15B 5/003; F15B 13/0438
See application file for complete search history.

(56) References Cited

U.S. PATENT DOCUMENTS 3,278,702 A * 10/1966 Kreuter ..... G05D 23/1925 200/81 R
3,533,032 A * 10/1970 Caspar ..... H01F 7/14 137/625.65
3,556,150 A 1/1971 King et al.
4,094,463 A * 6/1978 Milewski ..... G05B 11/50 137/86
4,189,092 A * 2/1980 Maxson ..... F24F 13/04 236/13
5,499,650 A 3/1996 McArthur et al.
8,499,756 B2 * 8/2013 Bathurst ..... H02S 20/00 126/581

FOREIGN PATENT DOCUMENTS

| | | | |
|---|---|---|---|
| DE | 10303855 | A1 | 8/2004 |
| GB | 1584914 | A | 2/1981 |
| WO | 8909477 | A1 | 10/1989 |
| WO | 8910243 | A1 | 11/1989 |
| WO | 9924783 | A1 | 5/1999 |
| WO | 2004006349 | A2 | 1/2004 |

OTHER PUBLICATIONS

European Search Report for Application No. 16159650.7-1754, dated Sep. 2, 2016, 7 Pages.

* cited by examiner

*Primary Examiner* — Eric Keasel
(74) *Attorney, Agent, or Firm* — Cantor Colburn LLP

(57) ABSTRACT

A flapper for use in a servovalve is described, the flapper comprising a first material and a second material, the first material having a first coefficient of thermal expansion and the second material having a second coefficient of thermal expansion and wherein the first and second coefficients of thermal expansion are different to each other. An armature/flapper assembly is also described, which comprises this flapper as well as a plate and a torsion bridge. A method of compensating for alteration of the null of a servovalve due to temperature changes in a servovalve is also described.

7 Claims, 3 Drawing Sheets

FLAPPER AND ARMATURE/FLAPPER ASSEMBLY FOR USE IN A SERVOVALVE

FOREIGN PRIORITY

This application claims priority to European Patent Application No. 16159650.7 filed Mar. 10, 2016, the entire contents of which is incorporated herein by reference.

TECHNICAL FIELD

The examples described herein relate to a flapper and an armature/flapper assembly for use in a servovalve.

BACKGROUND

A hydraulic servovalve is a servo with a device (either flapper nozzle or jet pipe) used to position the servo. When servovalves are controlled through an electrical signal they are called electrohydraulic servovalves. Servovalves are normally used when accurate position control is required and this position control may be achieved through a closed loop control system, consisting of command sensor, feedback sensor, digital or analogue controller, and the servovalve.

Flapper nozzle systems for use in servovalves are well known. Flapper position is controlled by the electromagnetic torque motor and the torque developed by the torque motor is proportional to the applied current, with currents generally being in the milliamp range. A torque motor consists of two permanent magnets with a coil winding attached to a magnetically permeable armature. The armature is part of the flapper piece. When a current is applied to the coils, magnetic flux acting on the ends of the armature is developed. The direction of the magnetic flux (force) depends on the direction of the current. The magnetic flux will cause the armature tips to be attracted to the ends of the permanent magnets (current direction determines which magnetic pole is attracting and which one is repelling). This magnetic force creates an applied torque on the flapper assembly, which is proportional to the applied current. In the absence of any other forces, the magnetic force would cause the armature to contact the permanent magnet and effectively lock in this position. However, other forces are acting on the nozzle, such that flapper position is determined through a torque balance consisting of magnetic flux (force), hydraulic flow forces through each nozzle, friction on the flapper hinge point, and any spring (wire) connecting the flapper to the spool (which is almost always used in servovalves to improve performance and stability).

As the applied current is increased, the armature and flapper will rotate. As the flapper moves closer to one nozzle, the flow area through this nozzle is decreased while the flow area through the other nozzle increases.

Servovalves can be used to control hydraulic actuators or hydraulic motors. When a servoactuator is used to control an actuator, the servovalve and actuator combination are often referred to as a servoactuator. The main advantage of a servovalve is that a low power electrical signal can be used to accurately position an actuator or motor. The disadvantage is their complexity and the resulting costs of components consisting of many detail parts manufactured to very tight tolerances. Therefore, servovalves are generally only used when accurate position (or rate) control is required.

SUMMARY

A flapper for use in a servovalve is described, the flapper comprising a first material and a second material, the first material having a first coefficient of thermal expansion and the second material having a second coefficient of thermal expansion and wherein the first and second coefficients of thermal expansion are different to each other.

In any of the examples described herein, the flapper may comprise an elongated cylindrical component that extends along a longitudinal axis from a first end to a second end, the flapper having a length extending between said first end and said second end. Said flapper may further comprise a first segment comprising said first material and a second segment comprising said second material.

In any of the examples described herein, the first segment and the second segment may extend longitudinally along at least a part of said length.

In any of the examples described herein, the first segment and the second segment may extend longitudinally along the full length of the flapper.

In any of the examples described herein, the flapper may be bimetallic and the first segment may comprise a first metal and the second segment may comprise a second metal.

In any of the examples described herein, the first material may be an aluminum alloy and the second material may be molybdenum.

An armature/flapper assembly for use in a servovalve is also described, said armature/flapper assembly comprising any of the flappers described herein. The assembly may further comprise a plate, and a torsion bridge. The flapper may also comprise an elongated cylindrical component that extends along a longitudinal axis from a first end to a second end. The flapper may be connected to the plate at said first end, the plate being connected to the torsion bridge, and the torsion bridge being connectable to a body of the servovalve.

In any of the examples described herein, the plate may extend in a plane perpendicular to the longitudinal axis of the flapper.

Any of the new flappers described herein may be used in a servovalve and any of the new flapper/armature assemblies described herein may be used in a servovalve.

A servovalve is described herein comprising a first nozzle and a second nozzle and any of the new flappers described herein may be positioned within the servovalve so that said first material of the flapper faces said first nozzle and said second material of the flapper faces said second nozzle.

In any of the examples described herein, the servovalve may further comprise at least one permanent magnet with a coil winding, the permanent magnet being attached to a magnetically permeable armature comprising any of the new flappers described herein and further comprising means for applying an electrical current to the coils.

In any of the examples described herein the plate may be rectangular in shape.

The physical characteristics that define the flapper of the armature/flapper assemblies described herein are selected to automatically compensate for any movement of the second end due to temperature changes.

In any of the examples described herein, such characteristics may include Young's Moduli and coefficients of thermal expansion of the first material and the second material.

In some examples, such characteristics may include the geometry of the first segment and the second segment.

A method of compensating for alteration of the null of a servovalve due to temperature changes in a servovalve is also described herein. The method comprising providing a flapper within the servovalve, said flapper comprising a first material and a second material, the first material having a first coefficient of thermal expansion and the second material having a second coefficient of thermal expansion and wherein the first and second coefficients of thermal expansion are different to each other.

In any of the examples described herein, the new flapper may comprise an elongated cylindrical component that extends along a longitudinal axis from a first end to a second end, and the method may further comprise the step of connecting said first end of said flapper to a plate and connecting said plate to a torsion bridge to form an armature/flapper assembly, and connecting said torsion bridge to said servovalve.

In any of the examples described herein, the method may further comprise the step of positioning said plate to extend in a plane perpendicular to the longitudinal axis of the flapper.

In any of the examples described herein, the flapper may comprise an elongated cylindrical component that extends along a longitudinal axis from a first end to a second end, and may have a length extending between said first end and said second end, and said flapper may further comprise a first segment comprising said first material and a second segment comprising said second material, and said first segment and said second segment may extend longitudinally along at least a part of said length. The servovalve may further comprise a first nozzle and a second nozzle, and the method may further comprise the step of positioning said flapper within said servovalve so that said first material of the flapper faces said first nozzle and said second material of the flapper faces said second nozzle.

In any of the examples described herein, the servovalve may further comprise at least one permanent magnet with a coil winding, said permanent magnet being attached to a magnetically permeable armature comprising any of the new flappers described herein and the method may further comprise applying an electrical current to the coil winding.

DETAILED DESCRIPTION

Figure 1:
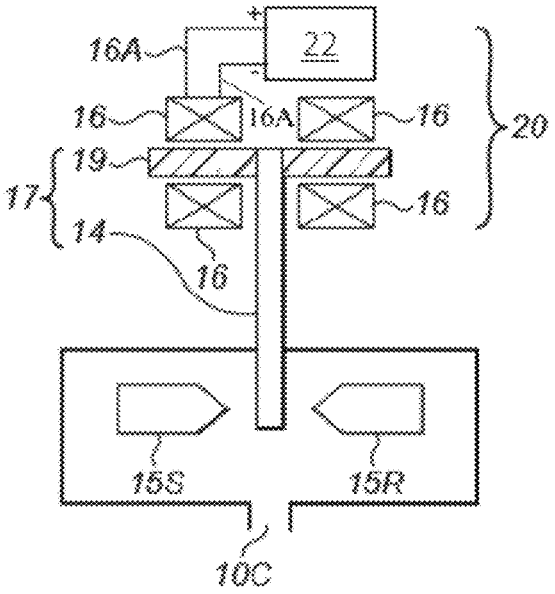
FIG. 1 PRIOR ART
FIG. 1 is a schematic diagram showing a known armature assembly for use in a servovalve when no current is applied to the coils and the flapper is in a null position.

As is known in the art, a servovalve is a device used for regulating either the flow rate or pressure gain at the receiving end of the system, i.e. some kind of actuator. It is controlled by a relatively low-power signal supplied to the coils of a torque motor. For reference, an example of one type of servovalve is depicted in FIG. 1. The new flapper and armature/flapper assembly described herein may be used with the type of servovalve shown in FIGS. 1 and 2 and described below, but is not, however, limited to this, and may also be used with other types of servovalves. The servovalve depicted in FIG. 1 is therefore one example of a servovalve with which the new flapper and armature/flapper assemblies as described later, can be used.

FIG. 1 is a schematic diagram showing an armature assembly 17 for a servovalve in this situation, when no current is applied to the coils 16 and the flapper 14 is in a null position. This servovalve shown in FIG. 1 has two nozzles, a supply nozzle 15S and a return nozzle 15R. A torque motor (represented by the numeral 20) is connected to an armature assembly 17 (the assembly comprising an armature plate 19 and an armature flapper 14) with one or more coils 16 wrapped around the armature plate 19. The coils are connected via leadwires 16A to a source of electricity 22 to thereby provide an electrical current to the coils 16.

The torque motor 20 is an electromagnetic circuit in which the current flowing through the coils 16 creates a force perpendicular to the surface of the armature plate 19. The armature itself is fixed on torsion shafts (not shown), which twist when a force (and therefore torque) is applied, and therefore the whole armature assembly 17, 19, 14, rotates.

This rotation changes the position of the flapper 14 between the nozzles 15S, 15R. The flapper 14 moves proportionally to the electric signal applied to the coil 16 (in FIG. 1 there are two of those in the torque motor, to enhance reliability and make them redundant). When there is no signal, such as the case shown in FIG. 1, the flapper 14 is in a "null" position, where the flapper 14 is equidistant from the nozzles 15S, 15R, and (if it is a three way, Flow Control Servovalve) the fluid is flowing freely from the Supply nozzle 15S to the Return nozzle 15R. The control flow is zero.

If a positive signal is applied, the flapper 14 moves towards the Supply nozzle 15S and with sufficient magnitude of the signal seals it. In this situation the fluid flows from the Control port 10C to a Return port (not shown), through the Return nozzle 15R. If the signal is negative and the Return nozzle 15R is sealed, the fluid flows from the Supply nozzle 15S to the Control port 10C.

Figure 2:
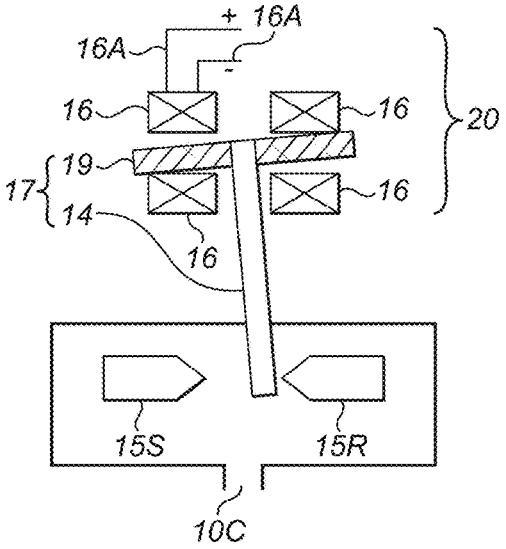
FIG. 2 PRIOR ART
FIG. 2 is a schematic diagram of a known armature assembly for use in a servovalve when a current with a negative signal is applied to the coils and the return nozzle is sealed.

In contrast to this, a situation wherein a negative signal is applied to the coils is depicted in FIG. 2 wherein the flapper 14 moves towards the Return nozzle 15R. The Flow Rate should therefore be a linear function of the input current.

In such known devices and methods, the flapper 14 is manufactured from a single homogenous material.

Figure 3:
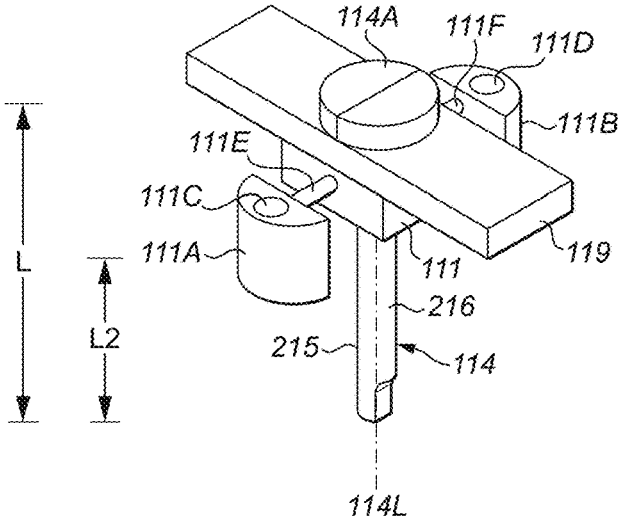
FIG. 3 is a detailed schematic diagram of a new type of flapper and armature/flapper assembly as described herein for use in a servovalve.
Figure 4:
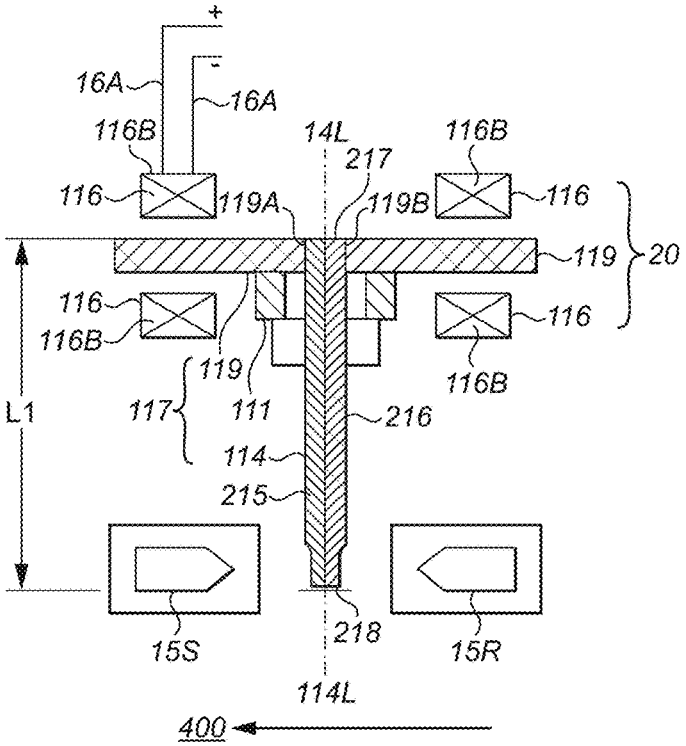
FIG. 4 is a schematic diagram showing a cross section of a new type of flapper and flapper/armature assembly as described herein for use in a servovalve.

A new type of flapper 114 and flapper/armature assembly 117 is now described with reference to FIGS. 3 to 5. As described above, these new flappers 114 and flapper/armature assemblies 117 can be used in a servovalve such as that described with reference to FIGS. 1 and 2, or in other types of servovalve. The new type of flapper/armature assembly 117 may be described as comprising three main parts: the flapper 114, the plate 119 and the torsion bridge 111. The flapper 114 is a longitudinal part of the assembly 117 having a longitudinal axis 114L, which is connectable to the plate 119. The flapper 114 may be brazed to the plate 119 or connected to the plate 119 by other connection methods. The part 114A of the flapper 114 which is seen as being above the surface of the plate 119 in FIG. 3 is cut off and removed after the braze is ready, as shown in FIG. 4, wherein this part 114A has been removed. The plate 119 may in some examples be rectangular but in other examples may be comprise other similar shapes and is manufactured from a magnetically permeable and uniform material. Due to this, in use, when a current is applied to the coils 116, the plate 114 is then attracted to or repelled from the magnetic poles of the torque motor magnets 116B, depending on the current.

The plate may be seated and brazed to or otherwise connected to the torsion bridge 111. The torsion bridge 111 may then be fixed to the body of the servovalve via connection means 111A and 111B which in FIG. 3 can be seen as "ears" protruding from the sides of the torsion bridge 111, with through holes 111C, 111D on the upper sides). In the example shown in FIG. 3, the connection 111A, 111B means are connected to the torsion bridge 111 by torsion shafts 111E, 111F.

FIG. 4 depicts an example of a new type of flapper 114 and armature/flapper assembly 117 positioned in the servovalve described with reference to FIGS. 1 and 2.

This new flapper 114 differs from known flappers and armature/flapper assemblies in that it comprises more than one material. Specifically, the new flapper may be bimetallic and the two metals each have a different coefficient of thermal expansion to each other. In some examples, not shown in the figures, the new flapper may even comprise a plurality of different materials/metals having different coefficients of thermal expansion. These new types of flappers and armature/flapper assemblies are now described in detail below.

In the example shown in FIG. 4, the flapper 114 may comprise an elongated solid cylindrical component that extends longitudinally along a first longitudinal axis 114L between a first end 217 and a second end 218. In this example, the flapper 114 comprises a length L1 extending from the first end 217 to the second end 218. The flapper 114 may further comprises at least two longitudinal segments (in this example only two segments are used 215, 216) each of which extend longitudinally along the length L1 of the flapper 114. These segments 115, 116 also extend longitudinally along the axis 14L as shown in FIGS. 3 and 4. In some examples, such as that shown in FIG. 4, the first and second segments 215, 216 extend along the full length L1 of the flapper 14 between the first end 217 and second end 218, i.e. all the way from the first end 217 to the second end 218.

In other examples, these segments 215, 216 may extend longitudinally along only a part L2 of the length L1 of the flapper 114, as shown in FIG. 3. In some examples, such as that shown in FIG. 3, these first and second segments 215, 216 may only extend along a section of the length of the flapper that is nearest to the second end 218 of the flapper. Each of the two parts 215, 216 comprises a different material to the other. In particular, the first part 215 may comprise a material having a first coefficient of thermal expansion and the second part 216 may comprise a material having a second coefficient of thermal expansion, wherein the first and second coefficients of thermal expansion are different to each other. These two materials may be metals having different coefficients of expansion to each other.

The flapper 114 may be connected at its first end 217 to the plate 119, as described above with reference to FIGS. 1 to 3. The flapper 114 may be brazed, or otherwise connected to the plate 119 at connection points 119A, 119B. As can be seen in FIG. 4, the part 114A of the flapper 14 that protrudes above the plate 119 has now been removed as described earlier. In this example, the plate 119 is rectangular shaped and extends in a plane perpendicular to the longitudinal axis 114L of the flapper 114. In other examples, different shapes may be used to enhance the effect of the magnetic flux.

The flapper 114 may therefore be described as comprising two segments 215, 216 made from different materials or metals with different thermal expansion coefficients. These two segments 215, 216 do not have to be identical in size and do not necessarily have to have the same thickness as each other, as the ideal thickness would depend on the ratio of the Young's Modulus of the two materials selected. In some examples, the connection between the two materials may be a spot weld, or other suitable methods known in the art.

The armature assembly 117 may be used in a servovalve such as that shown in FIGS. 1 and 2. When in use within the servovalve, the first end 217 of the flapper 114 is fixed to the plate 119 as described above, while the other end 218 is then free to move between the nozzles 15S, 15R. In normal operating conditions, the plate 119 rotates and causes the flapper 114 to rotate as well as described above.

As mentioned above, in previously known devices, the flapper 114 would have been manufactured out of a single homogeneous material and the null of the servovalve in normal conditions would geometrically be defined as a situation where the distances between the flapper and each nozzle are equal. Therefore, in known devices, if the temperature increases the null changes (due to changes of physical properties of the fluid) and is no longer present in the same position of the flapper as it was. There was previously therefore a need to compensate for this by means of changing the control signal (i.e. current).

In contrast to this, with the new flapper 114 and armature assembly 117 described herein and shown in FIGS. 3 and 4, it is no longer necessary to compensate for this by changing the current, as the compensation is performed mechanically and therefore occurs automatically, by design. This is achieved due to the fact that as the temperature increases, the two materials of the flapper 114 elongate unevenly with respect to each other and therefore cause the flapper 114 to bend in one direction. See FIG. 5 which depicts the degree of bending that an armature assembly comprising a bimetallic flapper 114 may undergo in the presence of an increase in temperature.

Figure 5:
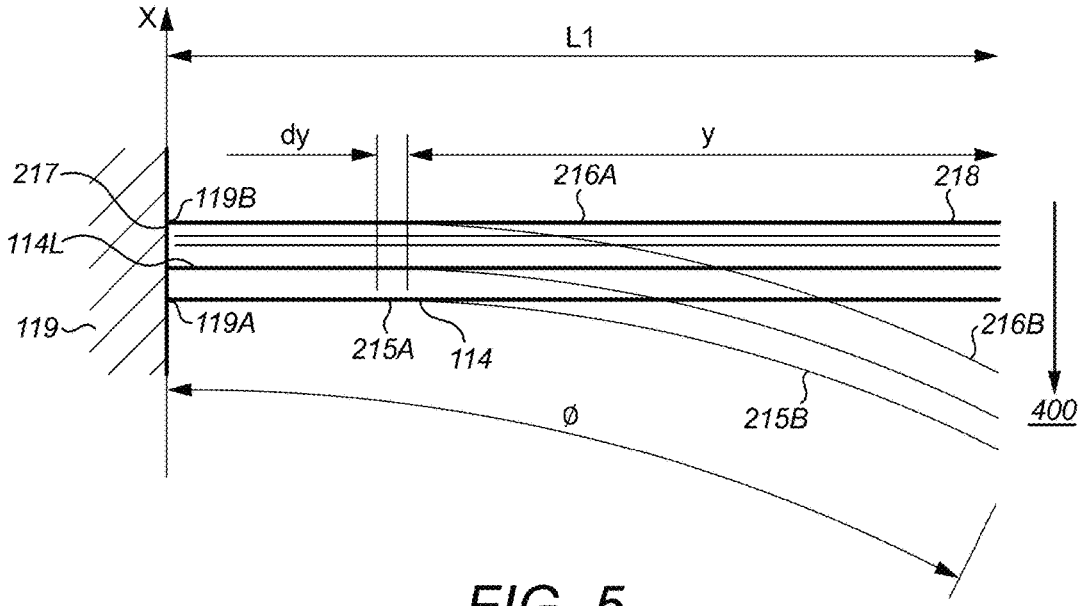
FIG. 5 depicts the degree of bending that a new type of flapper as described herein may undergo in the presence of an increase in temperature.

FIG. 5 depicts the degree of bending that a bimetallic flapper 114 may undergo in the presence of an increase in temperature. The reference numerals 215A, 216A represent the position of the first segment 215 and second segment 216 of the flapper respectively before any temperature increase has occurred. The reference numerals 215B, 216B represent the position of the flapper and the corresponding first and second segments of the flapper respectively after a temperature increase has occurred. As can be seen in this figure, the flapper 114 has been displaced or bent in the direction 400 by an angle 4) of displacement.

In FIG. 5, dy represents an infinitely small dimension of this section of the bimetallic structure which is oriented perpendicularly to the longitudinal axis of the structure. In this figure, y represents the distance between this dy section and the free, unfixed end 218 of the bimetallic element. This in turn changes the distances between the flapper 114 and the nozzles 15S, 15R. If the materials, thicknesses and lengths of the materials for the flapper are chosen properly according to their Young's modulus, the displacement of the free end 218 of the flapper 114 (as well as the point on the flapper 114 located on the nozzle centre line) is large enough to compensate for the change of the null.

In some examples, the flapper 114 may be bimetallic comprising a first segment 215 made from a first metal having a first coefficient of thermal expansion and a second segment 216 made from a second metal having a second coefficient of thermal expansion different to the first coefficient. In some examples, the flapper 114 may be made from a first segment 215 comprising an aluminium alloy and a second segment 216 comprising Molybdenum. In this case, the first and second segments may have an almost equal thickness to each other. In this example, the stresses in any cross section would be symmetrical (and change direction in the middle, where the two materials meet) and the neutral bending line would run along the connection between the two materials.

Bimetallic structures like this one have a "bimetallic constant", which is called either Curvature or the sensitivity of the bimetal. It determines how much the structure will bend when the temperature rises by one degree Celsius. It is constant for a given geometry and material properties (Young's Modulus, thermal expansion coefficient) and does not depend on the sum of thicknesses of the two materials, but the overall cross section area is limited anyway, by the strength of the material to be used in such application and the design constraints.

The curvature, or the sensitivity $k_t$ is defined as:

$$k_t = \frac{6E_1E_2g_1g_2(g_1+g_2)(\alpha_1-\alpha_2)}{4E_1E_2g_1g_2(g_1+g_2)^2+(E_1g_1^2-E_2g_2^2)^2}\left[\frac{1}{m\cdot{}^\circ C.}\right]$$

Where:

g1,2—Thicknesses of materials 1 and 2

E1,2—Young's Modulus of materials 1 and 2

α1,2—Thermal expansion coefficients of materials 1 and 2

In order to optimize (maximize) the sensitivity, an equation for the reciprocal of the sensitivity could be written:

$$\frac{1}{k_t} = \frac{2}{3}\frac{(g_1+g_2)}{(\alpha_1-a_2)} + \frac{(E_1g_1^2-E_2g_2^2)^2}{6E_1E_2g_1g_2(g_1+g_2)(\alpha_1-\alpha_2)}$$

Now it is visible, that if g1 and g2 are constant, the maximum value will be obtained if and only if the second part (circled) tends to zero, which means, that the numerator of this ratio has to be equal to zero. This leaves us with a simplified sensitivity equation:

$$k_t = \frac{3(\alpha_1-\alpha_2)}{2(g_1+g_2)}$$

And a condition, which defines "normal" bimetallic connections:

$$\frac{g_1}{g_2} = \sqrt{\frac{E_2}{E_1}}$$

The composition of Mo and some specific Al alloys is suitable for a 1,4/1,8 thickness ratio, however, some other compositions may also be suitable.

The angular displacement of a bimetallic armature like this would be calculated from the following equation:

$$\varphi = k_t L \Delta T$$

L-free length

ΔT-temperature change

In a case where small displacements and rotations are being investigated, however, during heating, this small section dy rotates as well, and this rotation can be written as $$d\varphi = k_t \times dy \times \Delta T$$

The angle dφ is small, so the values of sin (dφ) and cos (dφ) could be approximated by the value of the angle dφ itself. This may be used to obtain the equation for the maximum displacement change df=ydφ, which could be integrated and the value of the maximum displacement (at the free end in this case) will be obtained.

x and dx are similarly defined, dx is an infinitely small section along the x axis, located at distance x from the borderline axis between the two materials of the bimetallic strips. These two dimensions are used for stress calculations along the cross section of the bimetallic element The space between either nozzle and the surface of the flapper in the middle position is narrow. Usually, it should be larger from the filtration rate of the valve/system (defined as the biggest particle that can enter the servovalve/system) by a factor of 1.5. Servo systems are generally precise and do not allow for too many foreign objects/particles as they have a really small filter mesh and so the distance between one nozzle and the flapper in the middle position could be assumed at 0.1 mm=100 μm but is usually lower.

Using the formulas given above and some geometrical simplifications suitable for such small angular displacement, the linear displacement towards one of the nozzles will be approximately 11 μm at a 150° C. temperature change. This should compensate for the change of viscosity and density (the density, primarily) of the fluid as a function of temperature.

The physical characteristics that define the flapper of the armature/flapper assemblies described herein are therefore selected to automatically compensate for any movement of the second end due to temperature changes. In some examples, such characteristics may include Young's Moduli and coefficients of thermal expansion of the first material and the second material. In some examples, such characteristics may include the geometry of the first part and the second part.

The orientation of the specific metal is not random, and the two segments 215, 216 of the flapper 114 should be positioned so that the first segment 215 is facing a first nozzle, (e.g. 15S in FIG. 4) and the second segment 216 is facing a second nozzle (e.g. 15R in FIG. 4). In the example shown in FIG. 4, where it is desired that the flapper be bent to the left by means of temperature application, the material with the higher coefficient of thermal expansion is therefore placed on the right side. In another example, wherein it is desired that the flapper be bent to the right by means of temperature application, the material with the higher coefficient of thermal expansion is therefore placed on the left side.

The examples described herein which use flappers comprising two segments made of two different materials therefore provide significant advantages over known armature assemblies. As described above, this solution compensates for the influence of temperature on the null current, which is a critical characteristic in this product. There is no need to compensate for this on a system level anymore, by means of additional temperature sensors and feedback loops as is the case in known devices. The risk of failing the servovalve's requirements also decreases significantly as well, as the null shift caused as a function of temperature is limited. This solution can also stabilize the operation of the whole servovalve in harsh operating conditions, when the temperature oscillates, depending on the hydraulic load.

The invention claimed is:

1. A servovalve comprising a flapper, said flapper comprising:

an elongated cylindrical component that extends along a longitudinal axis (114L) from a first end (217) to a second end (218), the elongated cylindrical component having a length (L1) extending between said first end (217) and said second end (218), the elongated cylinder component being formed of a first segment (215) comprising a first material and a second segment (216) comprising a second material, wherein said first segment (215) and said second segment (216) extend longitudinally along at least a part (L2) of said length (L1), wherein the first material has a first coefficient of thermal expansion and the second material has a second coefficient of thermal expansion, and wherein the first and second coefficients of thermal expansion are different than each other;

further comprising a supply nozzle (15S) and a return nozzle (15R) and wherein said flapper (114) is positioned within said servovalve so that said first material (215) of the flapper faces said supply nozzle (15S) and said second material (216) of the flapper (114) faces said return nozzle (15R).

2. The servovalve of claim 1 wherein, both of said first segment and said second segment extend longitudinally along the full length of the flapper.

3. The servovalve of claim 1, wherein the flapper is bimetallic and said first segment comprises a first metal and said second segment comprises a second metal.

4. The servovalve of claim 1, wherein said first material is an aluminum alloy and said second material is molybdenum.

5. The servovalve of claim 1 further comprising an armature/flapper assembly that includes the flapper and further comprising a plate, and a torsion bridge;

wherein:

said flapper is connected to said plate at said first end, said plate is connected to said torsion bridge, and said torsion bridge is connectable to a body of said servovalve.

6. The servo valve of claim 5, wherein said plate extends in a plane perpendicular to the longitudinal axis of the flapper.

7. The servovalve of claim 1, further comprising:

at least one torque motor magnet with a coil winding; and means for applying an electrical current to the coils.

* * * * *